United States Patent [19]

Twigger et al.

[11] Patent Number: 4,608,899

[45] Date of Patent: Sep. 2, 1986

[54] CUTTING GUIDES FOR COVING

[75] Inventors: Ronald T. Twigger, Durrington; Raymond Dodkin, Langford, both of England

[73] Assignee: Wondertex Limited, Feltham, England

[21] Appl. No.: 720,785

[22] Filed: Apr. 8, 1985

[30] Foreign Application Priority Data

| | | | |
|---|---|---|---|
| Apr. 25, 1984 | [GB] | United Kingdom | 8410552 |
| Aug. 8, 1984 | [GB] | United Kingdom | 8420162 |
| Feb. 8, 1985 | [GB] | United Kingdom | 8503312 |

[51] Int. Cl.[4] ..... B27G 5/02

[52] U.S. Cl. ..... 83/745; 83/581; 83/761

[58] Field of Search ..... 83/745, 581, 486.1, 83/471.3, 767; 30/289, 293, 290

[56] References Cited

U.S. PATENT DOCUMENTS

| | | | |
|---|---|---|---|
| 87,703 | 3/1869 | Pons | 83/767 |
| 129,516 | 7/1872 | Bartlett | 83/745 |
| 752,050 | 2/1904 | Dunne | 83/767 X |
| 1,038,966 | 9/1912 | Russell et al. | 83/767 |
| 1,599,324 | 9/1926 | Franklin | 83/767 |
| 1,855,945 | 4/1932 | Denyer | 83/745 |
| 2,651,333 | 9/1953 | Spinney | 83/471.3 X |
| 4,031,794 | 6/1977 | Leihgeber | 83/745 X |
| 4,054,077 | 10/1977 | Gram | 83/745 |

*Primary Examiner*—Frank T. Yost

*Attorney, Agent, or Firm*—Beveridge, DeGrandi & Weilacher

[57] ABSTRACT

A cutting guide is disclosed for guiding a saw for a mitre cut, particularly at 45°, through a piece of coving. The guide provides a guide faces for sliding engagement by a saw or other cutter. The coving is typically placed on a bench with the intermediate rear surface of the coving flat on the bench. The guide is placed on top of the coving with notches or other engaging means locating the guide on the coving and a cut is made with the saw in contact with either face.

17 Claims, 6 Drawing Figures

FIG. 4.
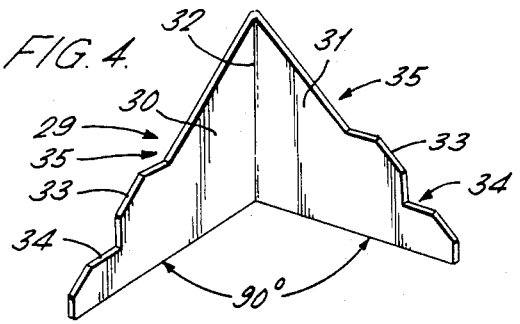
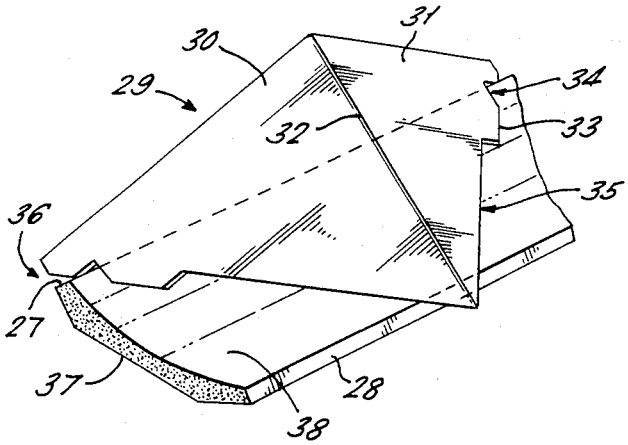
FIG. 5.
FIG. 6.
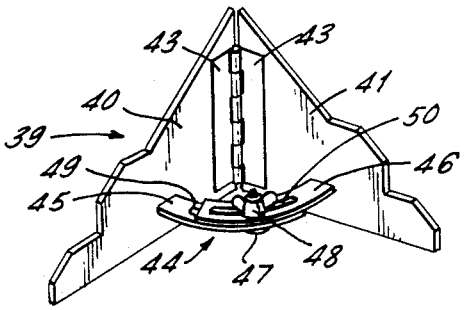

CUTTING GUIDES FOR COVING

BACKGROUND OF THE INVENTION

1. Field of the Invention

This invention relates to guides for cutting coving to form mitre joints, and a method of cutting coving to form a mitre joint.

2. Prior Art

Coving is used to cover the junction between the top of a wall of a building and the ceiling, and accordingly generally has two rear surface portions extending at right angles to one another. When the coving is in position, one of these surfaces is in contact with the wall and the other is in contact with the ceiling. Usually these two rear surfaces are joined by an intermediate rear surface inclined at 45 degrees to each of them. The major part of the front surface of the coving is normally curved, but there are two narrow strips, one of which in use is adjacent to the ceiling and extends parallel to the wall, while the other in use is adjacent to the wall and extends parallel to the ceiling.

When it is required to join two pieces of coving at an internal or external corner of a room, it is necessary to form a mitre joint. The plane of the most convenient mitre cut, required on each piece of coving, lies in a plane perpendicular to the ceiling and extending at 45 degrees to each wall. More accurately, in the case of an external joint, the plane of the cut extends at 135 degrees to each wall.

The required mitre cut can be made with the aid of a normal mitre box. However, in order to hold the saw blade at the correct angle with respect to the coving to provide the required cut, it is necessary for one of the two mutually perpendicular rear surfaces to be in contact with, or parallel to, the sides of the box and for the other such surface to be in contact with, or parallel to, the base of the box. This can be accomplished without too much difficulty if the coving fits within the mitre box. However the dimensions are normally such that the coving cannot be held conveniently within the box. Furthermore, since the intermediate rear surface joining the said two mutually perpendicular rear surfaces usually constitutes the major part of the rear of the coving, it would be more convenient to use this surface as the contact surface rather than either of the two mutually perpendicular surfaces which are usually relatively small.

SUMMARY

According to the invention there is provided a guide for cutting coving to form mitre joints, the guide being adapted to be placed against the coving and comprising means for engaging the coving so as to orientate the guide relative to the coving, and a guide face for sliding engagement by a cutter at the required angle of cut so as to guide the cutter whilst it cuts the coving.

Preferably the guide face is arranged to guide the cutted for a 45° cut.

The engaging means preferably acts to locate the guide laterally of the coving.

It is also preferred that the guide includes a second guide face for sliding engagement by a cutter to guide the cutter for a second cut through the coving at the required angle of cut, different to the first mentioned cut. The two guide faces are preferably provided by two portions joined along a common edge. The guide faces may be inclined at 90° relative to one another.

Conveniently, the or each guide face is generally in the shape of a triangle, for example, an isosceles triangle with its two equal sides inclined at 90°.

The guide may advantageously be formed from sheet material generally in the shape of an isosceles triangle having its two equal sides inclined at 90°, the sheet material being formed, e.g. by bending, along the perpendicular bisector of the base of the original triangle to an angle of 90° so that the two equal sides of the original triangle are inclined at 60°, and the original triangle forms the two flat portions inclined to each other at 90° and each being generally in the shape of an isosceles triangle having its two equal sides inclined at 90°. A portion of the apex of the original triangle is preferably removed parallel to the base of that triangle.

The engaging means may conveniently comprise at least one notch provided to engage over a corner edge of the coving.

In one embodiment of the invention said one notch is provided in and towards one end of an edge of the guide which, in use, lies adjacent the coving, and at least one other notch is provided in the same edge between the first mentioned notch and the other end of the edge, said one notch and the other notch or one of the said other notches being adapted to engage over opposite edges of the coving.

In another embodiment of the invention said one notch is provided in and towards one end of an edge of the guide which, in use, lies adjacent the coving, and a longer cut-out is provided in the same edge between the first mentioned notch and the other end of the edge, said one notch and the longer cut-out being adapted to engage over opposite edges of the coving.

The guide may be formed of plastics material or metal.

In a further embodiment, the guide as defined above has two portions joined together along a common edge which are inclined to each other, and means are provided for adjusting the angle of inclination.

In one case the two portions may be hinged along their common edge and joined by means which are capable of holding the portions at at least two different angles of inclination. The holding means may also allow for any angle of inclination between two limits.

The invention also provides a method of cutting coving to form a mitre joint, wherein the coving is placed on a support surface with the intermediate rear surface of the coving flat on the support surface, a guide as defined above is placed on top of the coving with the engaging means locating the guide laterally on the coving, and a cutter is laid against the or one of the guide faces of the guide and a cut is made with the cutter in contact with that guide face.

BRIEF DESCRIPTION OF THE DRAWINGS

FIG. 4 is a perspective view of a first modified cutting guide;

FIG. 5 shows the cutting guide of FIG. 4 located on a length of coving; and FIG. 6 is a perspective view of a second modified cutting guide.

DESCRIPTION OF THE PREFERRED EMBODIMENTS

Figure 1:
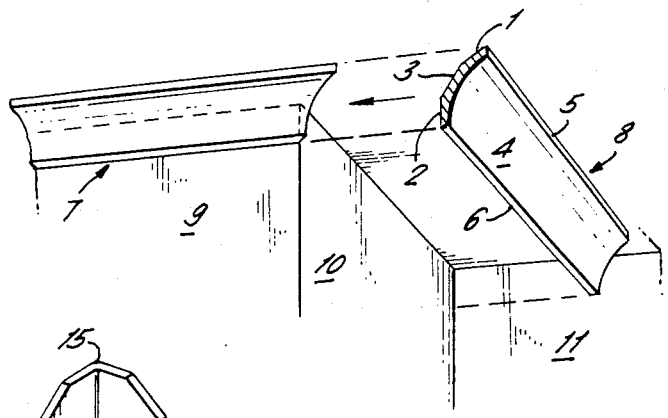
FIG. 1 illustrates the use of coving in a room.
Figure 3:
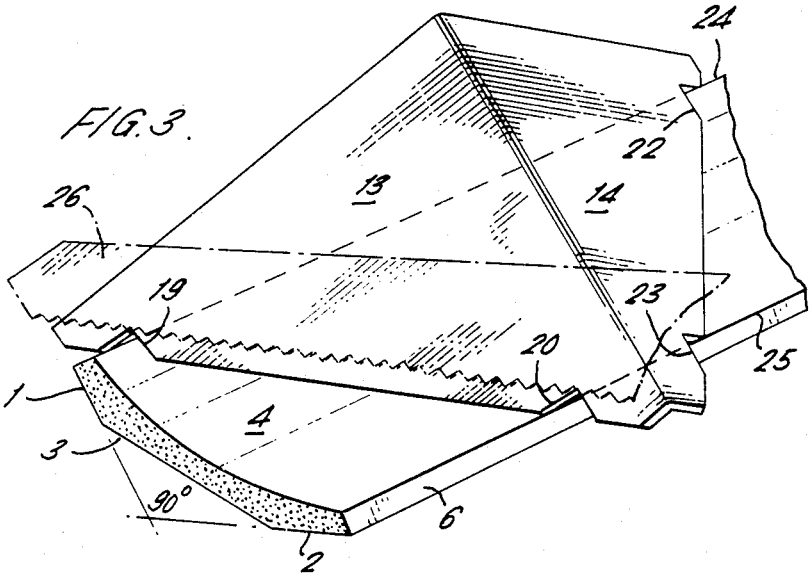
FIG. 3 is a further perspective view illustrating the use of the cutting guide shown in FIG. 2.

It will be seen from FIGS. 1 and 3 that the coving illustrated includes a first rear surface 1, a second rear surface 2 perpendicular to said first rear surface, and an intermediate rear surface 3 extending between the first and second surfaces. The coving also includes a front curved surface 4, a first front edge strip 5 adjacent to, and perpendicular to, the first rear surface 1, and a second front edge strip 6 adjacent to, and perpendicular to, the second rear surface 2.

One piece of coving 7 is shown attached between a wall 9 and a ceiling of a room, and terminating at the righthand end (as seen in FIG. 1) in an exterior mitre joint. A further length of coving 8 is shown being offered up to the length 7. To form the mitre joint, the righthand end of the length 7 and the lefthand end of the length 8 have both been cut in a plane extending perpendicularly to the ceiling and at 135 degrees to each of the two walls 9 and 10.

In the corner of the room, between the walls 10 and 11, it will be necessary to cut the ends of the two lengths of coving, which meet in this corner, along a plane extending perpendicularly to the ceiling and at 45 degrees to each of the walls 10 and 11.

Figure 2:
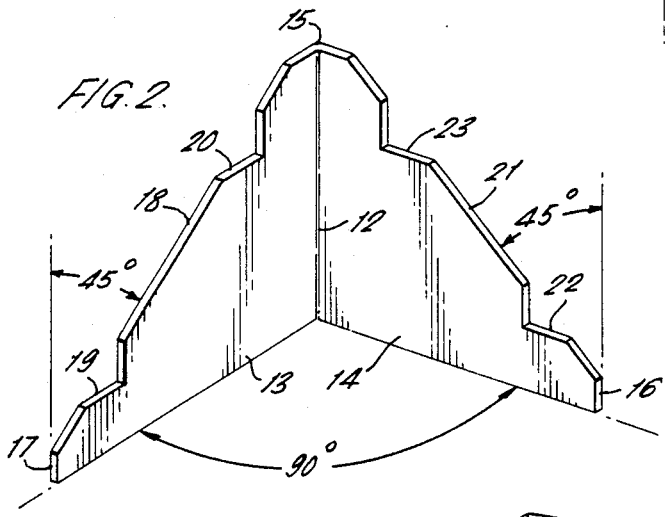
FIG. 2 is a perspective view of a cutting guide in accordance with the invention.

FIG. 2 of the drawings shows a cutting guide embodying the invention, which may be used to form the mitre cuts for the coving illustrated in FIG. 1. The guide, in this embodiment, comprises a triangular piece of sheet metal such as alloy steel, which is formed, e.g. by bending, along a line 12 to form two triangular portions 13 and 14 inclined at 90° to each other and joined along a common edge. Each of these triangles is substantially an isosceles triangle having a 90° apex and two base angles of 45°. The top of the guide is cut away parallel to the base of the original triangle, as shown at 15, and the two sides of the guide are cut away, as shown at 16 and 17. The triangular portion 13 has a base in which are provided two notches 19 and 20. Similarly, the triangular portion 14 has a base 21 in which are provided two notches 22 and 23. The notches 19,20,22,23 are for the purpose of orientating the guide relative to the coving by locating the guide laterally on the coving (see FIG. 3) although it will be understood that any other suitable locating means may be used, for example engaging one or both longitudinal sides of the coving.

In order to adapt the guide for cutting more than one size of coving, one or more extra notches (or other locating means) may be formed in the bases 18 and 21 of the two triangular portions.

The guide illustrated in FIG. 2 is shown in use in FIG. 3. The coving to be cut is placed on a bench with the intermediate rear surface 3 flat on the bench. The guide is then placed on top of the coving with the notches 19,20,22,23 engaging over the two corner edges 24 and 25 of the curved front portion of the coving. The saw (or other flat blade) can be laid against the side 13 as diagramatically illustrated at 26 in the drawing, or it can be laid against the side 14. The cut is made with the saw resting against the appropriate side of the guide, which side thereby forms a guide face for sliding engagement by the saw. Each cut will produce an external mitre on one side of the cut and an internal mitre on the other side. As can be seen from FIG. 3, when the saw 26 is in contact with the face 13, the cut on the righthand end of the lefthand piece of the coving will be an external mitre, while the cut on the lefthand end of the righthand piece is an internal mitre. Similarly, if the saw is used in contact with the face 14, the mitre formed on the lefthand end of the righthand piece of coving will be an external mitre, while the mitre formed on the righthand end of the lefthand piece of coving will be an internal mitre.

It can be seen that the cuts produced with the saw in contact with the surfaces 13 and 14 will produce the mitre angles required in this embodiment because each of the guide surfaces is contained in a respective plane perpendicular to the plane of the rear surface 2 and extending at an angle of 45 or 135 degrees with respect to the plane of the rear surface 1.

Instead of being made of bent sheet metal, the guide may alternatively be formed of plastics material or synthetic resin, for example, by moulding.

It is mentioned above that to adapt the guide for cutting more than one size of coving, one or more extra notches (or other locating means) may be formed in the base of each triangular portion.

With reference to FIGS. 4 and 5 there is shown a modified cutting guide 29 which has two triangular portions 30,31 joined along a common edge 32. As in the case of the guide illustrated in FIGS. 2 and 3, the angle of inclination between the triangular portions is 90°.

In the edge 33 of each triangular portion comprising the base of the triangle, is a notch 34 adjacent one end of the edge 33 and a longer cut-out 35 between the notch 34 and the other end of the edge 33. The provision of the longer cut-out 35 allows the guide to be suitable for more than one width of coving.

The provision of the longer cut-outs 35 instead of the notches 20,23 of the guide illustrated in FIG. 2, means that the guide has an apex at the adjacent end of the common edge 32. If desired, this apex can be cut away as at 15 in the guide of FIG. 2 to remove the sharp point which may be considered undesirable.

In use (see FIG. 5) a length of coving is rested on its rear face 37, reading for cutting. The guide 29 is rested on the front face 38 of the coving with the notches 34 engaged on one corner edge 27 of the coving. The longer cut-outs 35 of the guide engage the other corner edge 28 of the coving, and the upper faces of the triangular portions 30, 31 are thereby orientated relative to the coving at the desired angle of cut to achieve a right angle mitre joint.

In some cases, it may be desired to cut the coving to form mitre joints for corners which are not at 90°. This may be achieved by a rigid cutting guide of the same form as the guide of FIG. 2 except that the angle of inclination between the two triangular portions is a predetermined angle other than 90°.

However, the requirement for mitre joints for corners which are not at 90° may not be sufficient to justify the production of a range of cutting guides having different angles of inclination. Thus a convenient solution to this problem is provided by the modified cutting guide 39 illustrated in FIG. 6.

In this case, the triangular portions 40, 41 are identical to the equivalent triangular portions 30, 31 of the guide 29 (FIG. 4) but instead of being formed at a fixed angle of inclination at 90°, they are hinged together along their common edge by a hinge 43. Also means are provided for holding the portions 40, 41 at a variety of different angles of inclination. In the present embodiment these means comprise a rigid strap 44 formed of two parts 45, 46, each fixed to its respective triangular portion and joined by a bolt 47 and wing nut 48 engaging a slot 49 in the strap part 45 and a slot 50 in the other strap part 46. The angle of inclination is thereby adjustable between the limits set by the respective lengths of the slots 49 and 50.

If desired one of the strap parts 45, 46 may have a hole instead of a slot, the other still having a slot. This would reduce the maximum angle of inclination between the triangular portions 40, 41, but this may not be undesirable.

In a further embodiment, the strap parts 45, 46 may be provided with corresponding sets of holes (or only one hole in the case of one of the strap parts) instead of the slots. In this case, the guide would be adjustable between a series of specific angles of inclination between the triangular portions.

In each embodiment in which the guide is adjustable, the guide is set to the angle of inclination appropriate for the corner for which the mitre joint is required, and then engaged with the length of coving to be cut as shown in FIG. 5.

We claim:

1. A guide for cutting coving to form mitre joints, the guide being adapted to be placed against the coving and comprising means for engaging the coving so as to orientate the guide relative to the coving, a guide face for sliding engagement by a cutter at the required angle of cut so as to guide the cutter while it cuts the coving, the engaging means comprising at least one notch provided in and towards one end of an edge of the guide which, in use, lies adjacent the coving, and at least one other notch provided in the same edge between the first mentioned notch and the other end of the edge, said one notch and the other notch or one of said other notches being adapted to engage over opposite edges of the coving.

2. A guide as claimed in claim 1, wherein the guide face is arranged to guide the cutter for a 45° cut.

3. A guide as claimed in claim 1, the engaging means acting to locate the guide laterally of the coving.

4. A guide as claimed in claim 1, including a second guide face for sliding engagement by a cutter to guide the cutter for a second cut through the coving at the required angle of cut, different to the first mentioned cut.

5. A guide as claimed in claim 4, comprising two portions which provide the guide faces and which are joined along a common edge.

6. A guide as claimed in claim 5, wherein the two portions joined together along a common edge are inclined to each other, and means are provided for adjusting the angle of inclination.

7. A guide as claimed in claim 6, wherein the two portions are hinged along their common edge and joined by means which are capable of holding the portions at at least two different angles of inclination.

8. A guide as claimed in claim 7, wherein the holding means allow for any angle of inclination between two limits.

9. A guide as claimed in either claim 4, wherein the guide faces are inclined at 90° relative to one another.

10. A guide as claimed in claim 1, wherein each guide face is generally in the shape of a triangle.

11. A guide as claimed in claim 10, wherein the triangle is an isosceles triangle with its two equal sides inclined at 90°.

12. A guide as claimed in claim 1, formed of plastics material.

13. A guide as claimed in claim 1 formed of metal.

14. A guide for cutting coving to form mitre joints, the guide being adapted to be placed against the coving and comprising means for engaging the coving so as to orientate the guide relative to the coving, a first guide face for sliding engagement by a cutter at a required angle of cut so as to guide the cutter while it cuts the coving, a second guide face for sliding engagement by a cutter to guide the cutter for a second cut through the coving at a required angle of cut, different to the first mentioned cut, the guide faces being provided by two portions which are joined along a common edge, the said portions being formed from sheet material generally in the shape of a first isosceles triangle having two equal sides inclined at 90°, wherein the isosceles triangle also has a base, the sheet material being formed along a perpendicular bisector of the base of the first triangle to an angle of 90° so that the two equal sides of the first triangle are inclined at 60° and the first triangle forms the two flat portions inclined to each other at 90° and each being generally in the shape of an isosceles triangle having two equal sides inclined at 90°.

15. A guide as claimed in claim 13, wherein a portion of the apex of the original triangle is removed parallel to the base of that triangle.

16. A guide as claimed in claim 13, wherein the engaging means comprises at least one notch provided to engage over a corner edge of the coving.

17. A guide for cutting coving to form mitre joints, the guide being adapted to be placed against the coving and comprising means for engaging the coving so as to orientate the guide relative to the coving, a guide face for sliding engagement by a cutter at a required angle of cut so as to guide the cutter while it cuts the coving, the engaging means comprising at least one notch provided in and towards one end of an edge of the guide which, in use, lies adjacent the coving, and a longer cut-out provided in the same edge between the first mentioned notch and the other end of the edge, said one notch and the longer cut-out being adapted to engage over opposite edges of the coving.

* * * * *